US009489927B2

(12) United States Patent
Aizawa

(10) Patent No.: US 9,489,927 B2
(45) Date of Patent: Nov. 8, 2016

(54) INFORMATION PROCESSING DEVICE FOR CONTROLLING DIRECTION OF DISPLAY IMAGE AND CONTROL METHOD THEREOF

(71) Applicant: CANON KABUSHIKI KAISHA, Tokyo (JP)

(72) Inventor: Michio Aizawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 209 days.

(21) Appl. No.: 14/247,151

(22) Filed: Apr. 7, 2014

(65) Prior Publication Data

US 2014/0307001 A1 Oct. 16, 2014

(30) Foreign Application Priority Data

Apr. 10, 2013 (JP) ..... 2013-082185

(51) Int. Cl.
*G09G 5/38* (2006.01)
*G09G 3/20* (2006.01)

(52) U.S. Cl.
CPC *G09G 5/38* (2013.01); *G09G 3/20* (2013.01); *G09G 2340/0492* (2013.01); *G09G 2354/00* (2013.01)

(58) Field of Classification Search
CPC ..... G06F 3/0488; G06F 3/04845
See application file for complete search history.

(56) References Cited

U.S. PATENT DOCUMENTS

RE42,639 E * 8/2011 Anderson ..... 345/656
2007/0171240 A1* 7/2007 Koh ..... G09G 5/363 345/649
2008/0100638 A1* 5/2008 Chee ..... G06T 3/606 345/572
2009/0251565 A1* 10/2009 Molgaard ..... G03B 17/00 348/231.2
2010/0066763 A1* 3/2010 MacDougall ..... G06F 1/1626 345/656
2010/0156939 A1* 6/2010 Lee ..... G06F 1/1626 345/650
2012/0176413 A1* 7/2012 Kulik ..... G06F 1/1626 345/659
2013/0222516 A1* 8/2013 Do ..... H04N 7/147 348/14.01

FOREIGN PATENT DOCUMENTS

JP 2012-058332 A 3/2012

* cited by examiner

*Primary Examiner* — Maurice L McDowell, Jr.
(74) *Attorney, Agent, or Firm* — Canon USA, Inc., IP Division

(57) ABSTRACT

Information indicating a posture of the information processing device is periodically detected. When the posture of the information processing device indicated by the information has changed, the first display change unit rotates the image displayed on display unit. At this time, determination is made whether or not to cancel the rotation of the image by the first display change unit. If it is determined to cancel to rotate the image, the second display change unit changes the direction of the image to display on the display section to the direction to which the image was directed before it was rotated by the first display change unit.

15 Claims, 15 Drawing Sheets

| DIRECTION OF CURRENT DISPLAY IMAGE | DIRECTION OF FOLLOWING DISPLAY IMAGE | ROTATION DIRECTION / ROTATION ANGLE |
|---|---|---|
| UPWARD | UPWARD | NONE (0 DEGREE) |
| | DOWNWARD | ROTATE 180 DEGREES IN CLOCKWISE DIRECTION |
| | RIGHTWARD | ROTATE 90 DEGREES IN CLOCKWISE DIRECTION |
| | LEFTWARD | ROTATE 90 DEGREES IN COUNTERCLOCKWISE DIRECTION |
| DOWNWARD | UPWARD | ROTATE 180 DEGREES IN CLOCKWISE DIRECTION |
| | DOWNWARD | NONE (0 DEGREE) |
| | RIGHTWARD | ROTATE 90 DEGREES IN COUNTERCLOCKWISE DIRECTION |
| | LEFTWARD | ROTATE 90 DEGREES IN CLOCKWISE DIRECTION |
| RIGHTWARD | UPWARD | ROTATE 90 DEGREES IN COUNTERCLOCKWISE DIRECTION |
| | DOWNWARD | ROTATE 90 DEGREES IN CLOCKWISE DIRECTION |
| | RIGHTWARD | NONE (0 DEGREE) |
| | LEFTWARD | ROTATE 180 DEGREES IN CLOCKWISE DIRECTION |
| LEFTWARD | UPWARD | ROTATE 90 DEGREES IN CLOCKWISE DIRECTION |
| | DOWNWARD | ROTATE 90 DEGREES IN COUNTERCLOCKWISE DIRECTION |
| | RIGHTWARD | ROTATE 180 DEGREES IN CLOCKWISE DIRECTION |
| | LEFTWARD | NONE (0 DEGREE) |

FIG. 8

INFORMATION PROCESSING DEVICE FOR CONTROLLING DIRECTION OF DISPLAY IMAGE AND CONTROL METHOD THEREOF

BACKGROUND OF THE INVENTION

1. Field of the Invention

The present invention relates to a technology for rotating display image according to posture, inclination and the like of the device.

2. Description of the Related Art

Some information processing devices with a display, such as smart phones, tablet PCs and the like, include function of rotating to the display image output on the display (auto rotation of the display image) according to the inclination (posture) change of the device. This allows a user to fit the size of the displayed content to a vertically-long screen or to a laterally-long screen to adjust the width and the size of the display content. As is known, the posture of the information processing device is detected with a gravity sensor mounted to the information processing device. According to the detection result, the direction of the display image is controlled such that the bottom side of the display image is positioned on the lower side in the direction of gravity acceleration.

The control method as mentioned above, however, has a problem in that in a situation where the user is lying holding the information processing device, the posture of the information processing device is not stable and the display image may be rotated in a direction not intended by the user.

In order to solve the problem, there is a conventional art of mobile terminal device disclosed in Japanese Patent Application Laid Open No. 2012-058332. When it was detected that the mobile terminal device has moved to the lower position in a vertical direction over a constant distance, the mobile terminal device locks the auto rotation of the display image. In particular, in a case where the terminal information device has moved to the lower position in a vertical direction over a constant distance, it is determined that the user laid down. Then, the mobile terminal device locks the auto rotation of the display image. This prevents the display image from being rotated after locking the auto rotation of the display image even the posture of the information processing device is not stable.

According to the mobile terminal device disclosed in Japanese Patent Application Laid Open No. 2012-058332, it is possible to lock the auto rotation of the display image caused after the movement of the device. It is noted that, in an attempt to move the device, the auto rotation may be caused in the process of the movement. For example, in a case where the user places the device on a desk, the user first touches the outer right side of the device on the horizontal surface of the desk. Then, the user moves down the device in such a manner that the back surface of the device touches the desk. This is a natural behavior for the user to gently put the device on the desk. It means that the user is not intended to change the orientation of the display image. On the other hand, even in this case, the display image may be rotated automatically according to inclination of the device generated by the touch of the right edge of the device to the desk. As described above, there leaves a problem in that, during the movement of the device, the display image is automatically rotated in a direction not intended by the user.

SUMMARY OF THE INVENTION

According to an aspect of the present invention, there is provided an information processing device for controlling direction of an image to display on a display section, comprising: an acquisition unit configured to periodically acquire information indicating a posture of the information processing device; a first display change unit configured to rotate the image to display on the display section in a case where the posture of the information processing device indicated by the information acquired by the acquisition unit has changed; a rotation cancel determination unit configured to determine whether or not to cancel the rotation of the image by the first display change unit; and a second display change unit configured to change, in a case where it is determined to cancel the rotation of the image by the rotation determination unit, the direction of the image to be displayed on the display unit to the direction of the image before the rotation by the first display change unit.

Further features of the present invention will become apparent from the following description of exemplary embodiments (with reference to the attached drawings).

BRIEF DESCRIPTION OF THE DRAWINGS

FIG. 8 is one example of table for deriving the rotation direction and the rotation angle of the display image by comparing the direction of the following display image and the direction of the current display image.

DESCRIPTION OF THE EMBODIMENTS

Description will be made with regard to the embodiments with reference to the drawings.

Embodiments

Figure 1:
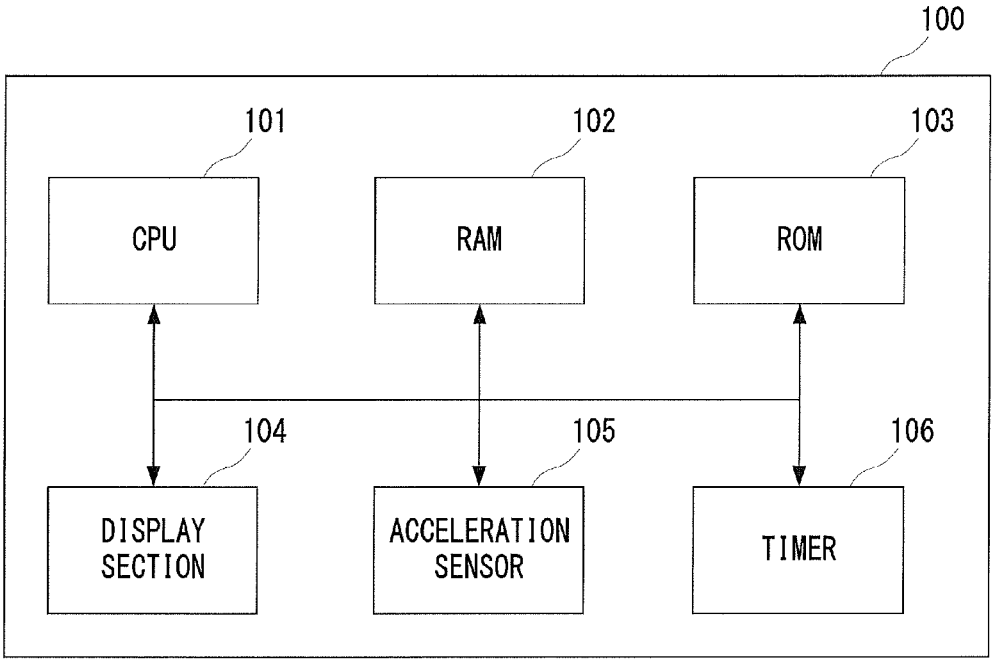
FIG. 1 is a block diagram of an example of hardware configuration of the information processing device.

FIG. 1 is a block diagram of an example of the hardware configuration of the information processing device in accordance with the present embodiment. The information processing device 100 is applied, for example, to smart phone, tablet PC, electronic dictionary, personal computer (PCs) and the like. Also, it is applicable to portable device, which can be carried by a user by the hand and is usable in various postures.

The information processing device 100 is comprised of a device body with built-in CPU 101, RAM 102, ROM 103, acceleration sensor 105 and timer 106 and display section 104 provided on a predetermined portion of the device body.

The CPU 101 performs the overall control of each component of the information processing device 100. The CPU 101 executes each processing using computer programs and various data stored in the RAM 102 and the ROM 103.

The RAM 102 has a work area for temporally storing computer programs or various data loaded from the ROM 103. Further, the RAM 102 has a work area used when various processing are executed with the CPU 101. It means that the RAM 102 enables to provide various work areas as appropriate. The ROM 103 stores computer programs and data.

The display section 104 is a display (screen) and an interface for displaying the display image. The acceleration sensor 105 consecutively detects moving state, such as acceleration, of the information processing device 100 (device body). The "moving state" means the state where the posture is changing. The timer 106 is to measure time, which has two states, such as "in operation" and "stop". The timer 106 receives three commands, such as "start", "state check", and "stop". The CPU 101 controls the operation. The timer 106 changes its state according to the command from the CPU 101. The state turns, for example, as follows.

(1) When the timer 106 receives "start" command when it is in "stop" state, the state turns to "in operation" state.

(2) When the timer 106 receives "stop" command when it is in "in operation" state, the state turns to "stop" state.

(3) When the time specified by the "start" command has elapsed, the state turns to "stop" state.

For example, when the timer 106 starts to measure (receives "start" command) time with the setup time of 1200 milliseconds, the state turns to "in operation" state. Then, after 1200 milliseconds, the state turns to "stop" state.

(4) When the CPU 101 sends "state check" command to the timer 106, the timer 106 returns the state of that time ("in operation" state or "stop" state).

The timer 106 measures the elapse of time set after a certain operation. For example, after a certain operation, measurement is started with the setup time of 1200 milliseconds. Then, the state of the timer 106 is checked. If the timer 106 is in "in operation" state, it means that the elapsed time is within 1200 milliseconds. If the timer 106 is in "stop" state, it means that 1200 milliseconds have elapsed. The timer 106 performs the first measurement (timer 1) and the second measurement (timer 2), which will be described later.

Figure 2A:
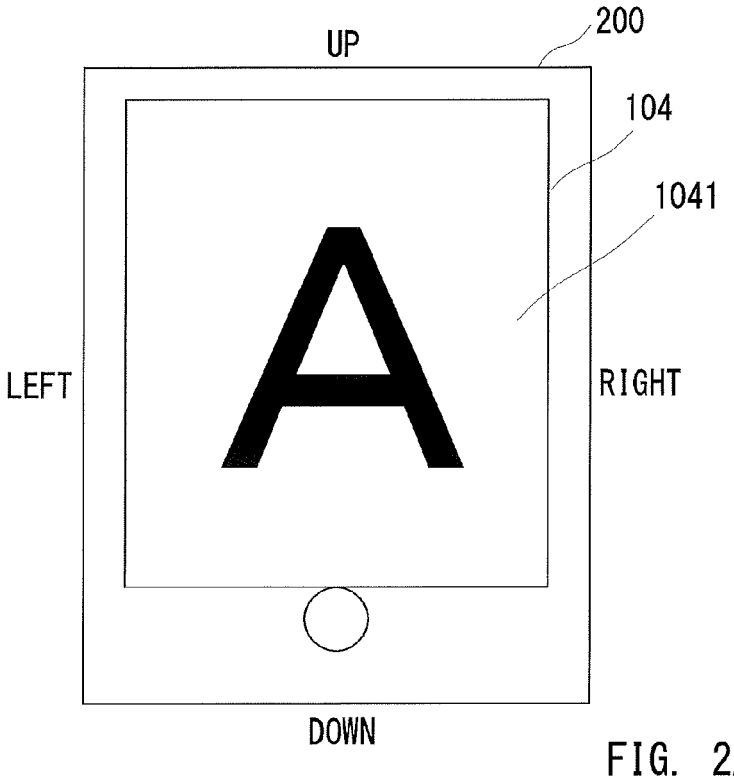
FIGS. 2 A and B are diagrams for explaining the direction of the display image in display unit.
Figure 2B:
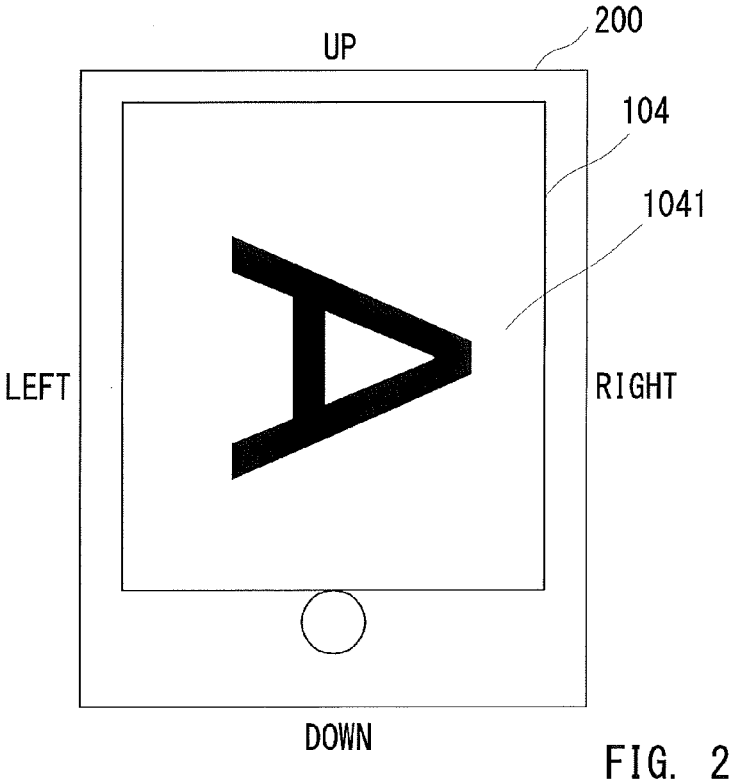

FIGS. 2A and 2B are explanatory diagrams showing a situation in which the display image is displayed on the display section 104 of the information processing device 100 (hereinafter referred to as screen display). In FIG. 2, the information processing device 100 is placed such that the screen 1041 is in vertically long direction. When this is viewed from the front, hereinafter, based on the direction of "up", "down", "right", and "left" of the device body 200, the upper side, lower side, left side and right side of the device body 200 are respectively defined so as to define the direction of the screen. FIG. 2A shows an example in which the display image including the letter "A" is displayed on the screen 1041. The example shows that the vertical (up-down) direction in the content of the display image corresponds to the vertical direction as defined with respect to the device body 200. The state of the screen 1041 as shown in FIG. 2A is hereinafter referred to as "display image in upward direction". On the other hand, FIG. 2B shows a case where the display image including "A" is rotated 90 degrees in clockwise direction, when viewed the screen 1041 from the front. As described above, the state of the screen 1041, in which the upward direction of the display screen corresponds to the right direction of the device body, is hereinafter referred to as "display image in rightward direction". Similarly, there are states referred to as "display image in downward direction" (not shown) and "display image in leftward direction" (not shown).

Figure 3:
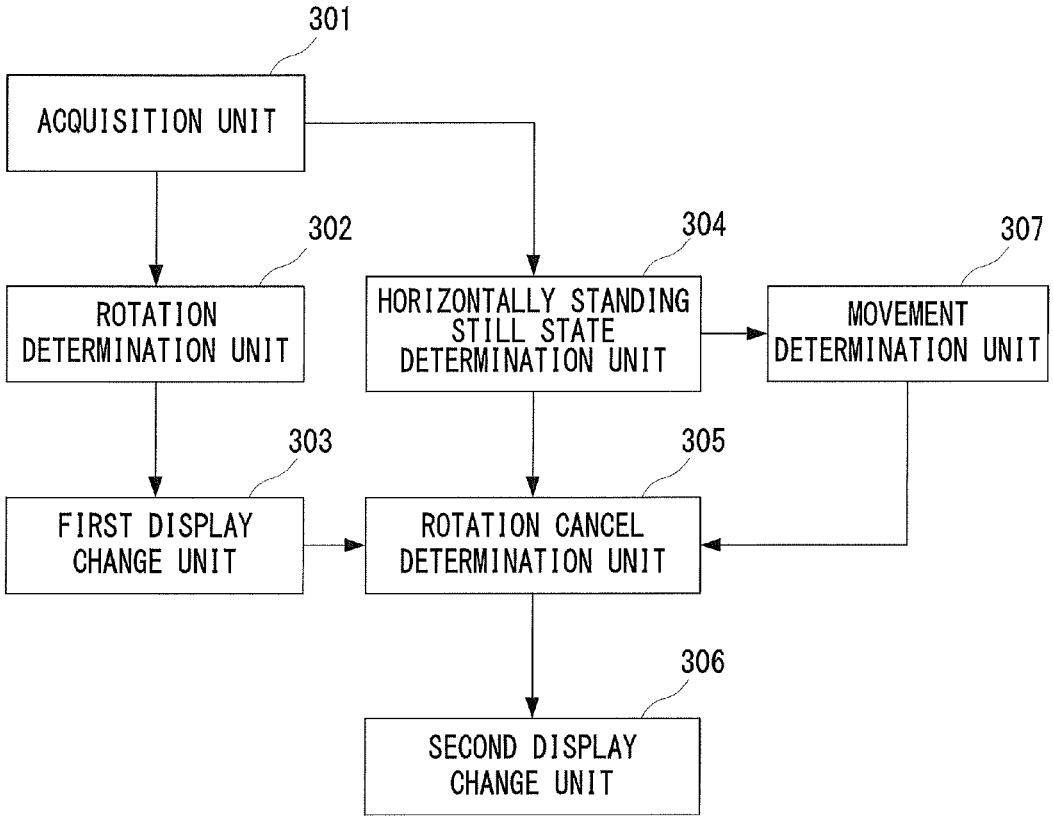
FIG. 3 is a block diagram showing an example of functional configuration of the information processing device.

FIG. 3 is a block diagram showing an example of functional configuration of the information processing device 100. In this embodiment, the CPU 101 reads program stored in the ROM 103 and develops the read program in the RAM 102 to execute them for realizing each of the functions described below. Here, the program loaded from the ROM 103 includes processing shown in a flowchart as will be described later. Note that, when hardware is configured as the replacement of software processing with the CPU 101, computing unit or circuit may be configured in accordance with the functions (processing unit) herein described.

Figure 4A:
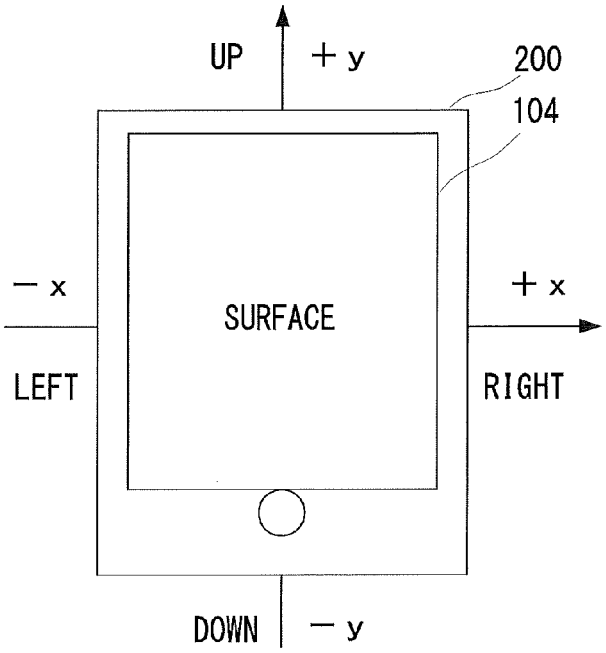
FIGS. 4A to 4D are diagrams for explaining acceleration direction acting on the information processing device.
Figure 4B:
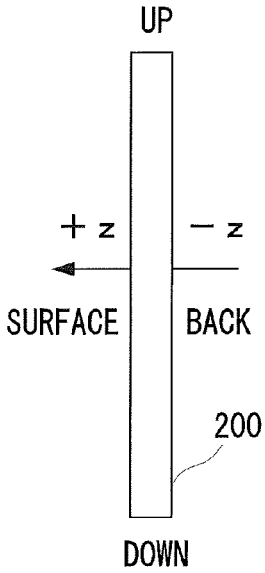
Figure 4C:
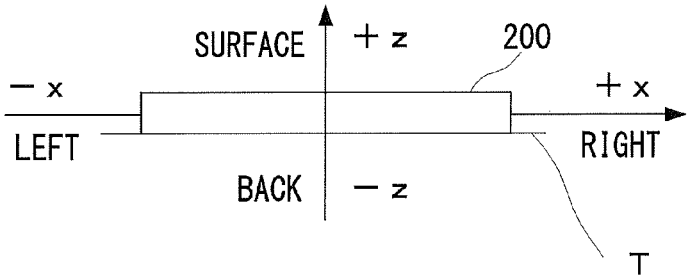
Figure 4D:
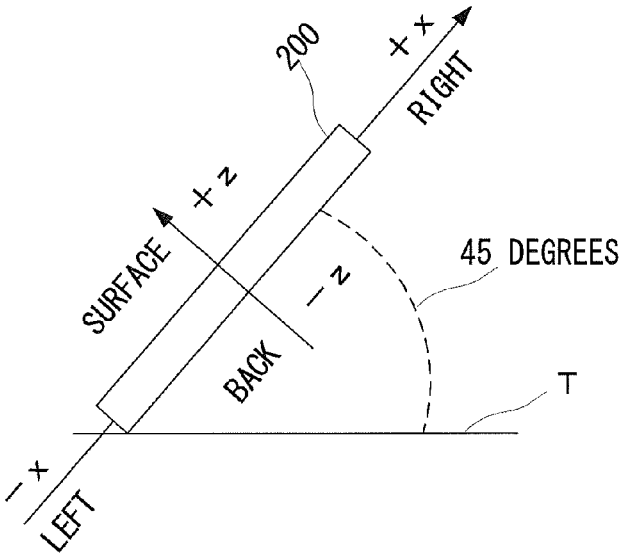

FIGS. 4A to 4D are diagrams for explaining acceleration direction which is detected by the information processing device 100 of the present embodiment to acquire the posture of the device body. As shown in FIG. 4A, a side where the screen of the device body 200 is located is defined as "surface". The acceleration component in the right direction acting on the device body 200 is defined as "x". Also, the acceleration component in the left direction acting on the device body 200 is defined as "−x" ("−" represents minus. The same applies hereinafter). Further, the component in upward direction is defined as "y". The component in downward direction is defined as "−y". As shown in FIG. 4B, the component in the surface direction is defined as "z". The component in the back direction is defined as "−z". FIG. 4C shows a case where, facing up the "surface", the image display device 100 is placed on a horizontal surface T (for example, desk). FIG. 4D shows one example of the posture of the image display device 100, in which the information processing device 100 is inclined at an angle of 45 degrees, as compared with the horizontal direction, with the right side of the information processing device 100 positioned relatively upper than the left side of the image display device. The posture of the image display device 100 can be represented by the inclination in the lateral direction and the inclination in the vertical direction.

The acquisition unit 301 acquires the information indicating the posture of the information processing device 100. The posture represents the inclination to the vertical direction, the orientation of the display section 104 and the like. According to the detection result of the acceleration sensor 105, the acquisition unit 301 of the present embodiment measures the acceleration acting on the information processing device 100 dividing component into three directions, i.e., direction x (+x, −x), direction y (+y, −y), and direction z (+z, −z), as shown in FIGS. 4A and 4B.

For example, facing up the "surface" of the information processing device 100, the information processing device 100 is placed on the horizontal surface T (FIG. 4C). At this time, the acceleration (gravity) of 1 G acts on the information processing device 100 in the vertically downward direction. The acceleration is, −1 G in z direction and 0 G in x direction and y direction.

Here, the acceleration acting on the information processing device 100 is, in addition to the gravity acceleration, the total of the acceleration when acted by the user's movement of the information processing device 100. Note that, gyro sensor may be used together so as to enhance the detection accuracy of the acceleration.

The rotation determination unit 302 estimates the posture of the information processing device 100 in accordance with the information detected and determines, based on the estimated result, whether or not it is necessary to rotate the display image. If it is determined that it is necessary to rotate the display image, the rotation determination unit 302 further derives the direction (clockwise or counterclockwise) and the angle (for example, 90 degrees, 180 degrees and the like) to rotate the display image.

If it is determined by the rotation determination unit 302 that it is necessary to rotate the display image, the first display change unit 303 rotates the display image in the direction derived by the angle derived.

The horizontally standing still state determination unit 304 determines, based on the acceleration measured, whether or not the information processing unit 100 is in horizontally standing still state. It means that the horizontally standing still state determination unit 304 is capable of detecting that the information processing device 100 is in horizontally standing still state.

The rotation cancel determination unit 305 determines to cancel the rotation of the display image in a case where, starting the start of the rotation of the display image by the first display change unit 303, the information processing device 100 horizontally stood still within a predetermined time (first predetermined time).

The second display change unit 306 executes to cancel the rotation of the display image. In particular, the second display change unit 306 rotates the display image in a direction opposite to that derived by the rotation determination unit 302 and with the same angle derived by the rotation determination unit 302. For example, if the direction derived by the rotation determination unit 302 is clockwise direction, the second display change unit 302 rotates the display image in a counterclockwise direction by the same angle. It means that the state returns to the original state. Triggered by, for example, the end timing of the rotation of the display image by the first display change unit 303, the cancellation of the rotation of the display image is started. If the rotation has already been ended, the cancellation is immediately started.

The movement determination unit 307 determines whether or not the information processing device 100 has moved, that is whether or not the user has moved the information processing device 100.

Figure 5:
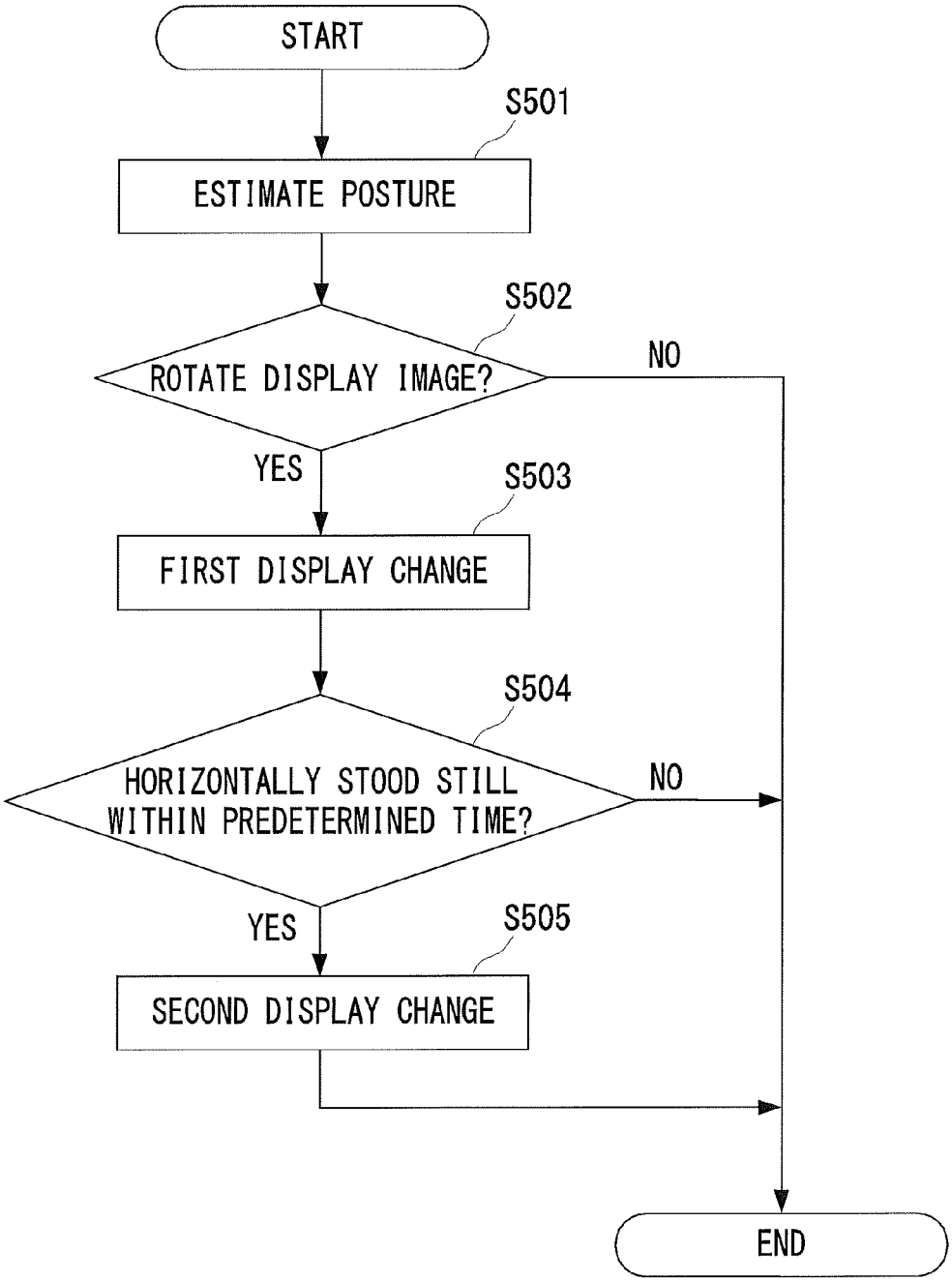
FIG. 5 is a flowchart for explaining basic operation of the information processing device.

FIG. 5 is a flowchart for explaining the basic operation of the information processing device 100. In this embodiment, in response to start up of the information processing device 100, the flowchart in FIG. 5 is started and the processing are periodically repeated.

First, the acquisition unit 301 acquires the detection result of the acceleration sensor 105 as the information indicating the posture of the information processing device 100. Then, based on the detected gravity acceleration, the rotation determination unit 302 estimates the posture of the information processing device 100 (S501).

Then, the rotation determination unit 302 determines whether or not it is necessary to rotate the display image according to the posture of the information processing device 100 estimated at S501 (S502). If it is determined that it is necessary to rotate the display image (S502: YES), the direction and the angle to rotate the display image are respectively derived. Then, the processing moves to the processing of S503. If it is determined that it is not necessary to rotate the display image (S502: NO), the processing is ended. Note that, the derived direction and the angle for the rotation are stored, for example, in the RAM 102.

The first display change unit 303 rotates the display image in accordance with the direction and the angle derived at S502 (S503). In this embodiment, the processing moves to the processing of S504 shortly after the first display change unit 303 started the rotation processing of the display image. It means that, without the need to wait the completion of the drawing of the display image after the rotation, it is possible to move to the next step. Note that, after the processing has moved to S504, the first display changing unit 303 continues to rotate the display image to the planned angle.

The rotation cancel determination unit 305 determines whether or not to cancel the rotation of the display image (S504). In particular, the rotation cancel determination unit 305 determines to cancel the rotation of the display image in a case where the horizontally standing still state determination unit 304 determined that the information processing device 100 horizontally stands still within the first predetermined time starting the start time of the rotation of the display image. If it is determined to cancel the rotation of the display image (S504: YES), the processing moves to the processing of S505. If not (S504: NO), the processing is ended.

The second display change unit cancels the rotation of the display image (S505) and rotates the display image in the direction opposite to that derived at S502 by the same angle derived at S502.

The each operation of the information processing device 100 will be described in detail.

Figure 6:
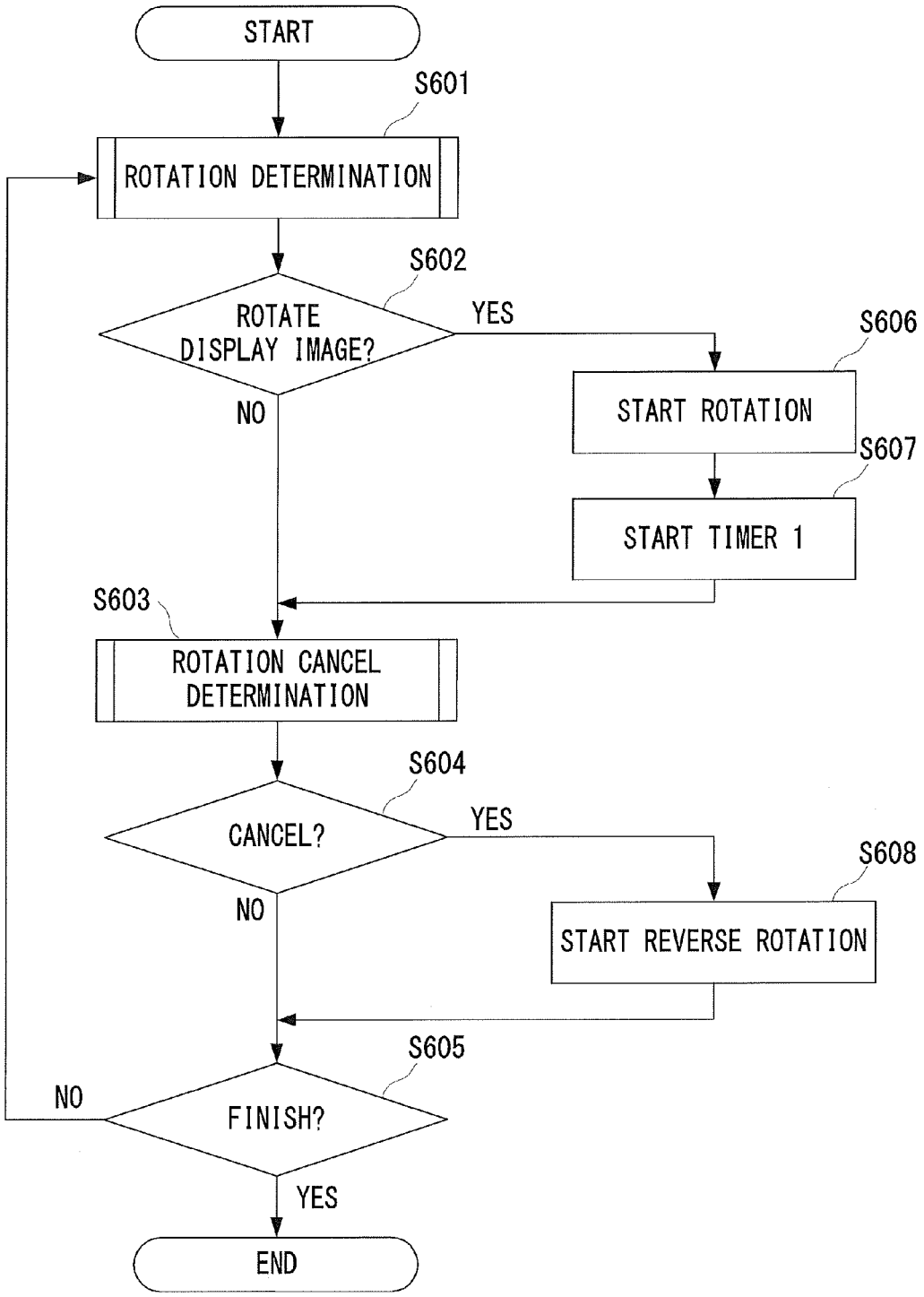
FIG. 6 is a flowchart for explaining processing procedure of the main loop of the information processing device.

FIG. 6 is a flowchart for explaining the detail of the processing procedure of the main loop (loop of S502 to S505) of the information processing device 100.

The rotation determination unit 302 determines whether or not it is necessary to rotate the display image (S601). Further, as described, if it is determined that it is necessary to rotate the display image (S602: YES), the direction and the angle to rotate the display image are respectively derived. Then, the processing moves to the processing of S606.

If it is determined that it is not necessary to rotate the display image (S602: NO), the processing moves to the processing of S603. If it is determined that it is not necessary to rotate the display image (S602: NO), the rotation cancel determination unit 305 determines whether or not to cancel the rotation of the display image (S603). If it is determined to cancel the rotation of the display image (S604: YES), the processing moves to the processing of S608. Then, the second display change unit 306 cancels the rotation of the display image started at the processing of S606 (S608) and rotates the display image in the direction opposite to that derived at S601 and by the same angle derived at S601. On the other hand, if it is determined not to cancel the rotation (S604: NO), the processing moves to the processing of S605. Then, when the rotation determination unit 302 receives the instruction to finish the information processing device 100 (S605: YES), the processing is finished. If not (S605: NO), the processing moves back to the processing of S601 and the rotation determination unit 302 further continues the processing.

On the other hand, if it is determined that it is necessary to rotate the display image (S602: YES), the first display change unit 303 rotates the display image in accordance with the direction and the angle derived at S601 (S606). The rotation cancel determination unit 305 starts timer 1 (first measurement) (S607). The timer 1 is set, in one embodiment, such that the state turns to "stop" state after 800 milliseconds.

For example, when the display image is rotated 90 degrees in clockwise direction from the state of "display image in upward direction", the state turns to the state of "display image in rightward direction". For example, the state may be changed to the state of "display image in rightward direction" at a time. Alternatively, the state may gradually be changed with animation.

Note that, when the state is changed at a time, in a case where the information processing device, which changes the display image 60 times per second is used, it maximally takes about 17 milliseconds (=1/60) to turn the display image to the state of "display image in rightward direction" at a timing of rewriting the display image. Further, when animation is used, it takes about 400 milliseconds to finally turn the display image to the state of "display image in rightward direction".

Figure 7:
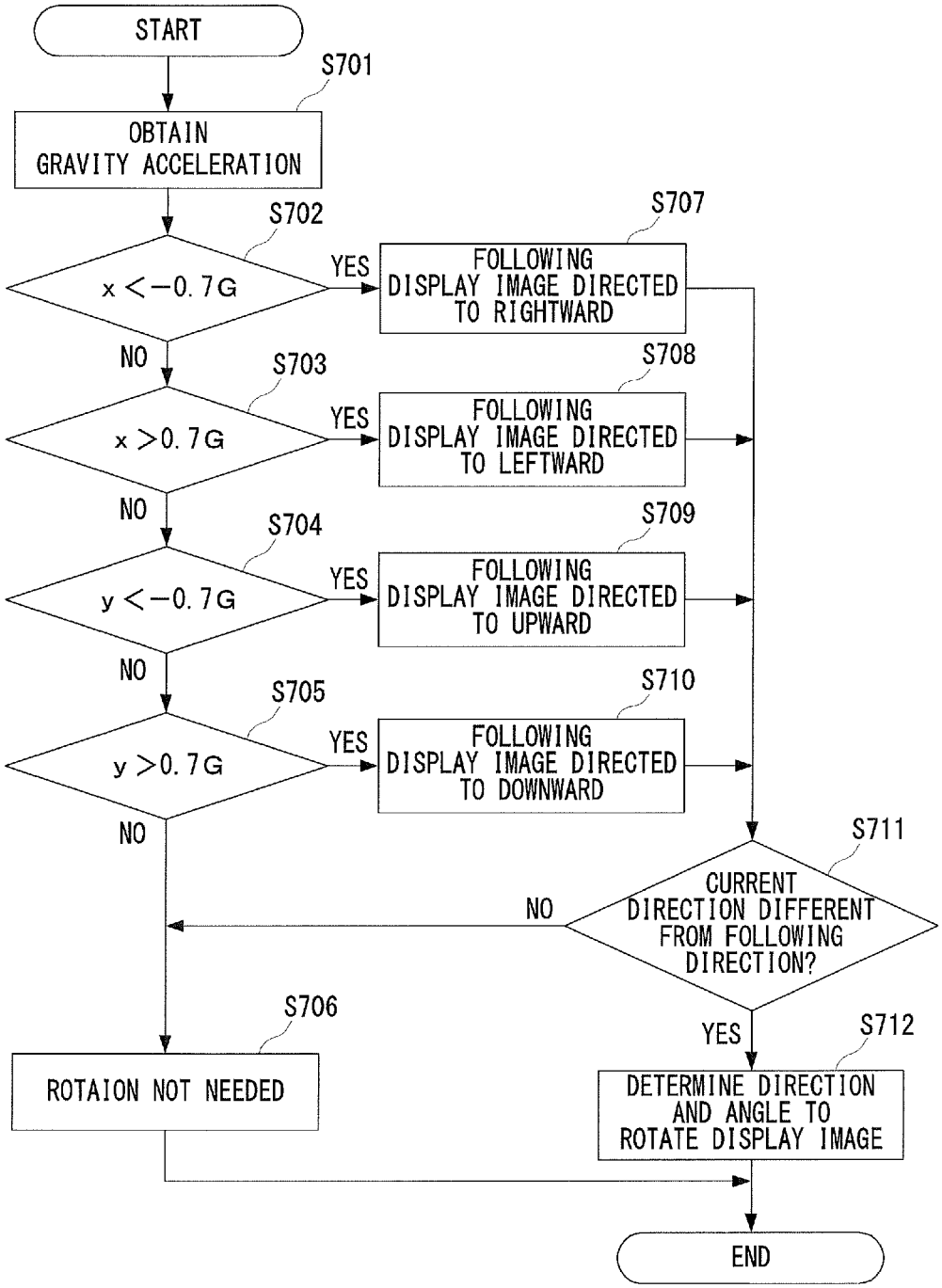
FIG. 7 is a flowchart for explaining particular processing procedure for determining rotation of the display image.

FIG. 7 is a flowchart for explaining a particular processing procedure of determining to rotate the display image (rotation determination unit 302: S601).

The rotation determination unit 302 analyzes the gravity acceleration acquired by the acquisition unit 301 to estimate the posture of the information processing device 100 (S701).

As described, the gravity acceleration of the information processing device 100 in x direction is 0 G for the posture as shown in FIG. 4C. Further, the gravity acceleration of the information processing device 100 in x direction is −0.7 G for the posture as shown in FIG. 4D. As described above, the gravity acceleration in x direction decreases if the right side of the information processing device 100 is lifted. Contrary, the gravity acceleration in x direction increases if the left side of the information processing device 100 is lifted. As described above, inclination in lateral direction of the information processing device 100 can be estimated based on the gravity acceleration in x direction. Similarly, inclination in vertical direction of the information processing device 100 can be estimated based on the gravity acceleration in y direction.

The rotation determination unit 302 determines whether or not the gravity acceleration in x direction is less than −0.7 G (S702). If it is determined to be less than −0.7 G (S702: YES), it means that, as compared with the horizontal direction, the information processing device 100 is inclined at an angle exceeding 45 degrees with the right side of the information processing device 100 positioned relatively upper than the left side of the information processing device 100. Therefore, the following display image is directed to "rightward" (S707). It means that, the direction of the display image of the information processing device 100 is changed such that the display image turns to the state of "display image in rightward direction". If it is determined to be more than −0.7 G (S702: NO), the processing moves to the processing of S703.

The rotation determination unit 302 determines whether or not the gravity acceleration in x direction is more than 0.7 G (S703).

In particular, if it is determined that the gravity acceleration is more than 0.7 G (S703: YES), it means that, as compared with the horizontal direction, the information processing device 100 is inclined at an angle exceeding 45 degrees with the left side of the information processing device 100 positioned relatively upper than the right side of the information processing device 100. Therefore, the following (changed) display image is directed to "leftward" (S708). It means that, the direction of the display image of the information processing device 100 is changed such that the display image turns to the state of "display image in leftward direction". If it is determined to be less than 0.7 G (S703: NO), the processing moves to the processing of S704.

The rotation determination unit 302 determines whether or not the gravity acceleration in y direction is less than −0.7 G (S704). If it is determined to be less than −0.7 G (S704: YES), it means that, as compared with the horizontal direction, the information processing device 100 is inclined at an angle exceeding 45 degrees with the upper side of the information processing device 100 positioned relatively upper than the lower side of the information processing device 100. Therefore, the following display image is directed to "upward" (S709). It means that, the direction of the display image of the information processing device 100 is changed such that the display image turns to the state of "display image in upward direction". If it is determined to be more than −0.7 G (S704: NO), the processing moves to the processing of S705.

The rotation determination unit 302 determines whether or not the acceleration gravity in y direction is more than 0.7 G (S705). If it is determined to be large (S705: YES), it means that, as compared with the horizontal direction, the information processing device 100 is inclined at an angle exceeding 45 degrees with the lower side of the information processing device 100 positioned relatively upper than the upper side of the image display device. Therefore, the following display image is directed to "downward" (S710). It means that, the direction of the display image of the information processing device 100 is changed such that the displayed image turns to the state of "display image in downward direction". If it is determined to be small (S705: NO), the rotation determination unit 302 determines that it is not necessary to rotate the display image (S706).

The rotation determination unit 302 compares the direction of the current display image with the direction of the following display image and determines whether or not the display images are directed in the same direction or not. If it is determined that the displayed images are directed in the same direction according to the comparison (S711: NO), the rotation of the display image is not needed (S706). Therefore, the processing is ended. Also, if it is determined that the displayed images are directed in the different direction according to the comparison (S711: YES), the rotation of the display image is determined to be needed. Then, the direction and the angle to rotate the display image are respectively derived according to the direction of the current display image and the direction of the following display image (S712).

In this embodiment, the direction and the angle to rotate the display image is derived, for example, with reference to a table shown in FIG. 8. In the table shown in FIG. 8, the direction of the current display image (upward, downward, leftward, rightward), the direction of the following display image (upward, downward, leftward, rightward), the direction and the angle (including 0 degree) to rotate the display image are interrelated, which are previously stored in the ROM 103.

The "direction of the current display image" is the direction to which the display image is directed before rotation, that is, it is the direction of the display image according to the inclination most recently detected. Further, the "direction of the following display image" is the direction to which the display image will be directed when the display image is rotated from the "direction of the current display image" according to the inclination detected.

For example, description is made in a case where the current display image is in "upward" direction and the following display image is in "rightward" direction. In this case, the direction to rotate the display image is derived to be "clockwise" and the angle to rotate the display image is derived to be "90 degrees". Further, description is made, for example, in a case where the current display image is in "upward" direction and the following display image is in "upward" direction. In this case, since the display image is rotated in the same direction, it is not necessary to rotate the display image.

Figure 9:
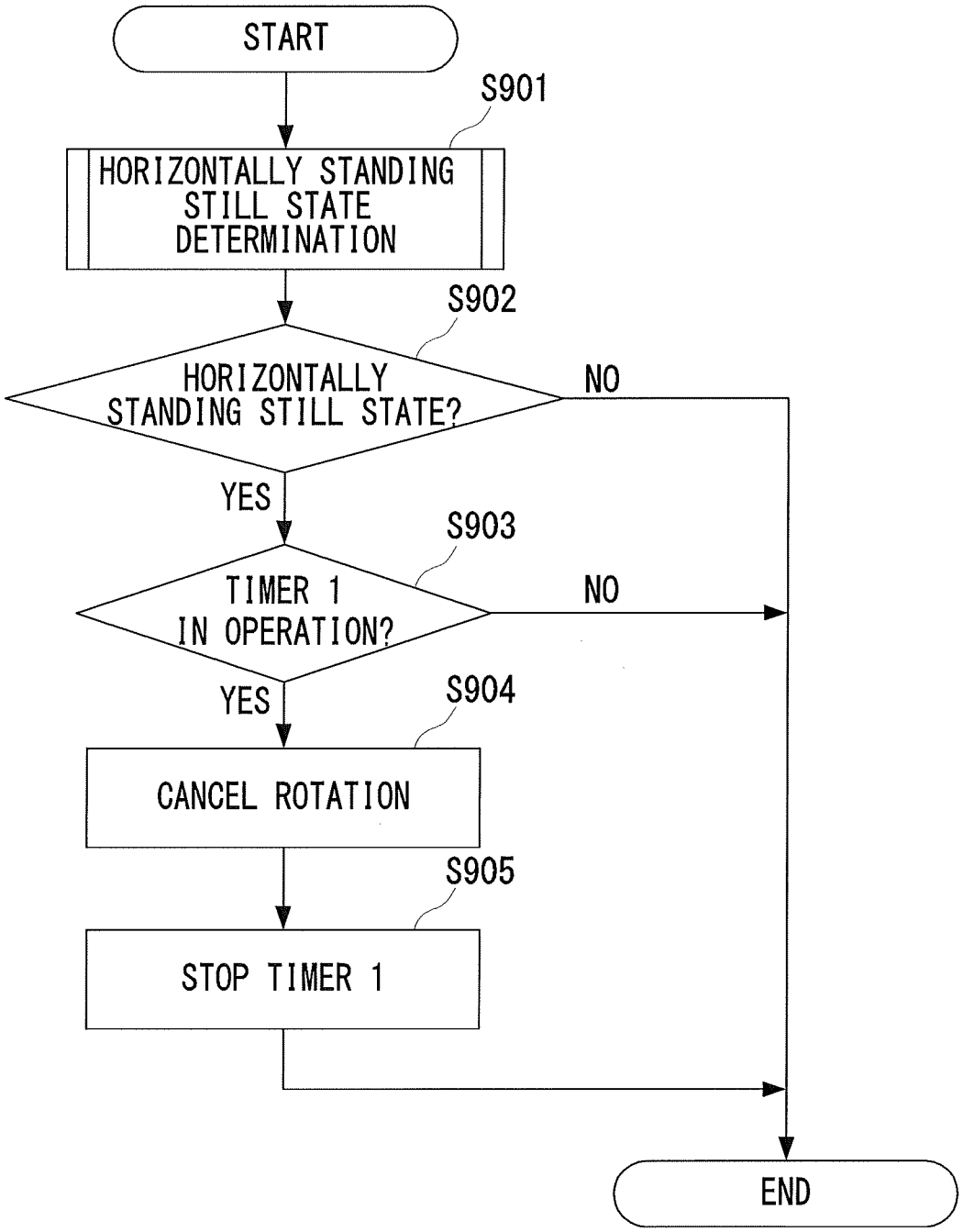
FIG. 9 is a flowchart for explaining particular processing procedure of determining to cancel the rotation of the display image.

FIG. 9 is a flowchart for explaining a particular processing procedure of determining to cancel the rotation of the display image (rotation cancel determination unit 305, S603).

The rotation cancel determination unit 305 determines whether or not the information processing device 100 is in horizontally standing still state including a case where the information processing device was placed on a desk. If it is determined to be in horizontally standing still state (S902: YES), the processing moves to the processing of S903. If it is determined not to be in horizontally standing still state (S902: NO), the processing is ended.

The rotation cancel determination unit 305 determines whether or not the timer 1 started at the processing of S607 (FIG. 6) is in "in operation" state (S903). If it is determined to be in "in operation" state (S903: YES), the rotation cancel determination unit 305 determines to cancel the rotation of the display image (S904), then, the rotation cancel determination unit 305 turns the state of the timer 1 to "stop" state (S905). If the timer is in "stop" state (S903: NO), the processing is ended.

Description is made with regard to determining to cancel the rotation of the display image. The fact that the timer 1 is in "in operation" state means that the information processing device 100 was placed on the horizontal surface within the first predetermined time after the start of the rotation of the display image. In other words, it means that immediately before placing the information processing device 100 on the horizontal surface, the display image was rotated. For example, in a case where the information processing device 100 is placed on the desk, the user first places (touch) the right side of the information processing device 100 on the desk. Then, the user moves down the device so as to place (touch) the left side of the information processing device 100 on the desk. This is a natural behavior for the user to gently place the information processing device 100 on the desk. It means that this is not the behavior to change the direction of the display image with intention. Therefore, even when above-mentioned conditions are satisfied and the display image is rotated, it is not the rotation intended by the user. Therefore, it becomes necessary to cancel the rotation of the display image.

Figure 10:
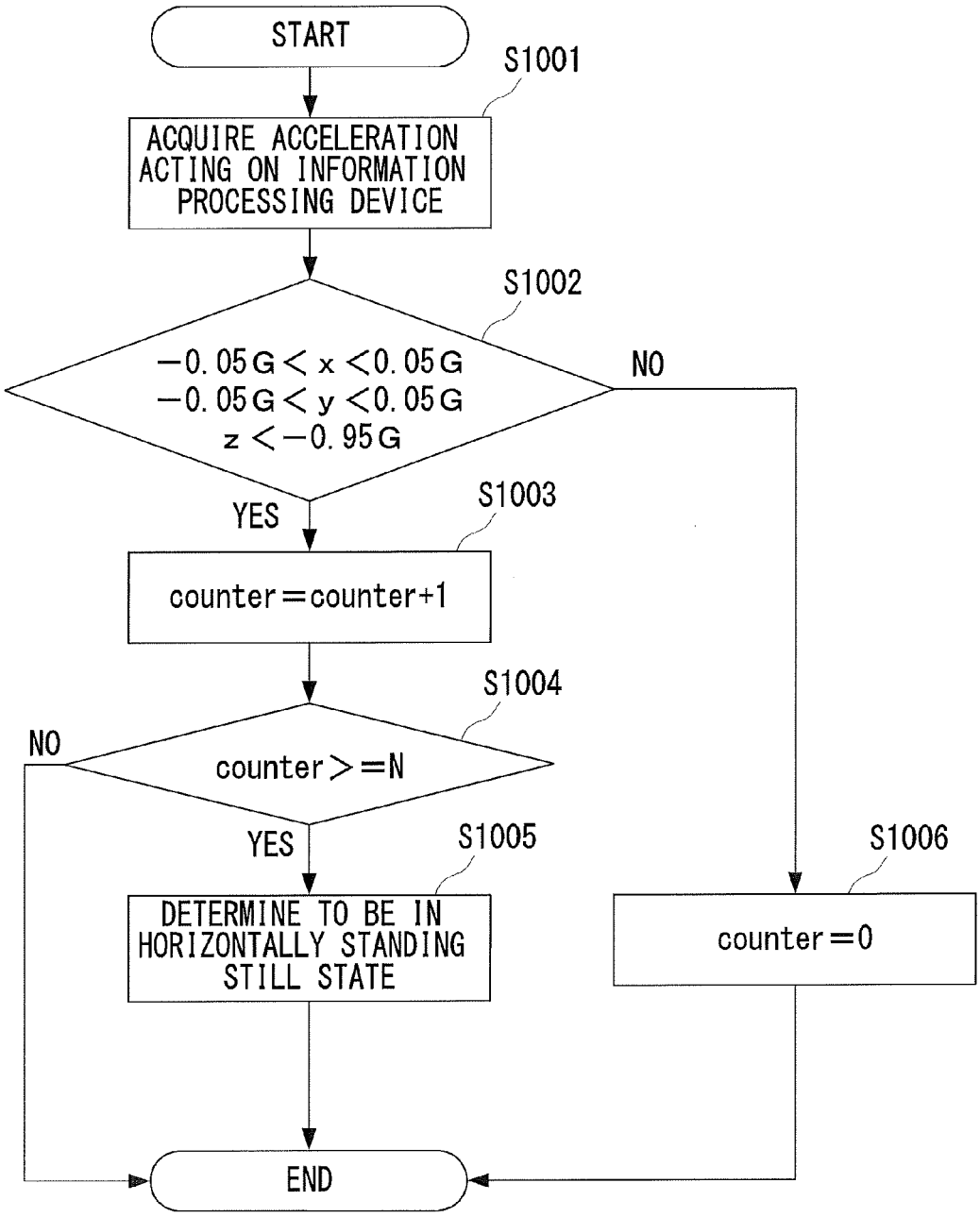
FIG. 10 is a flowchart for explaining particular processing procedure of horizontally standing still state determination.

FIG. 10 is a flowchart for explaining a particular processing procedure of determining horizontally standing still state (horizontally standing still state determination unit 304, S901) of the information processing device 100 as explained in FIG. 9.

The horizontally standing still state determination unit 304 acquires the measurement result of the acceleration acted on the information processing device 100 (S1001).

For example, facing up the "surface" of the information processing device 100, the information processing device 100 is placed on the horizontal surface T (FIG. 4C). At this time, the acceleration (gravity) of 1 G is acted on the information processing device 100 in the vertically downward direction. The acceleration is, −1 G in z direction and 0 G in x direction and y direction. As described above, determination is made whether the information processing device 100 is in horizontally standing still state.

The horizontally standing still state determination unit 304 determines whether or not the acceleration in x direction, y direction and z direction of the information processing device 100 respectively satisfies all the following conditions (S1002). One is that the acceleration in x direction is more than −0.05 G and less than 0.05 G ($-0.05\ G<x<0.05\ G$). One is that the acceleration in y direction is more than −0.05 G and less than 0.05 G ($-0.05\ G<y<0.05\ G$). The other is that the acceleration in z direction is less than −0.95 G ($z<-0.95\ G$).

If the acceleration of the information processing device 100 in x direction and y direction is 0 G and −1 G in z direction, that means an ideal horizontally standing still state. There may be a case, however, that the information processing device 100 may slightly be inclined when, for example, it is placed on the desk depending on the degree of horizontally of the top surface of the desk. Considering this, a margin is provided to the acceleration of each condition.

If each acceleration in x direction, y direction and z direction of the information processing device 100 satisfies all the predetermined conditions (S1002:YES), the horizontally standing still state determination unit 304 adds "1" to the value of the variable counter (S1003). If all the predetermined conditions are not satisfied (S1002: NO), the value of the variable counter is initialized to "0" (S1006) and then processing is ended. When starting up the information processing device 100, the value of the variable counter is initialized to "0".

The horizontal standing still determination unit 304 determines whether or not the value of the variable counter is equal to or more than a predetermined value N (N is natural number) (S1004). If it is determined that the value of the variable counter is equal to or more than the predetermined number N (S1004: YES), the information processing device is determined to be in horizontally standing still state (S1005). If not (S1005: NO), the processing is ended.

In particular, if the processing conditions of S1002 are consecutively satisfied over a constant number of times, the information processing device 100 is determined to be in horizontally standing still state. For example, suppose that the information processing device 100 is configured such that it performs the processing of determining horizontally standing still state every 20 seconds. Further, the value of the predetermined number N is set to be "4". In this case, if the processing conditions of S1002 are satisfied for at least 80 milliseconds, the information processing device 100 is determined to be in horizontally standing still state.

Figure 11A:
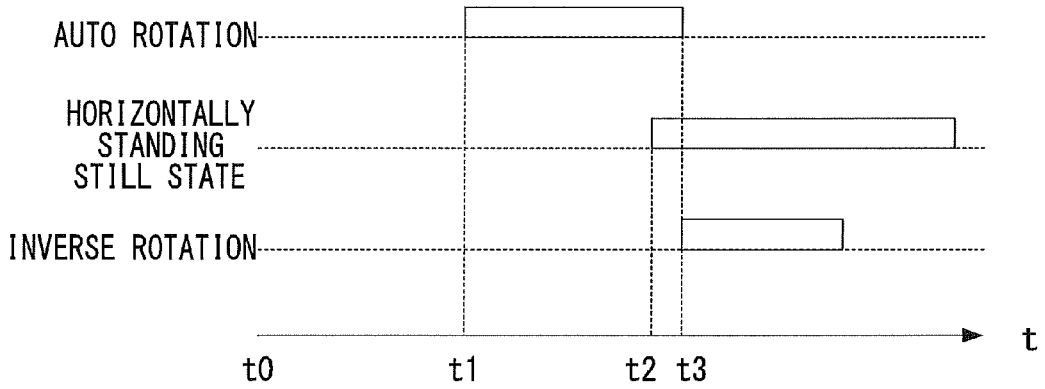
FIGS. 11A, 11B, and 11C are timing charts for explaining operation timing of the information processing device.
Figure 11B:
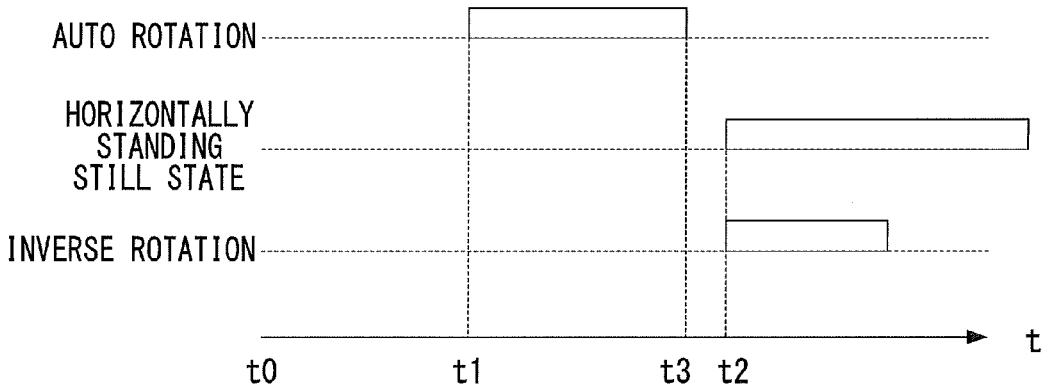
Figure 11C:
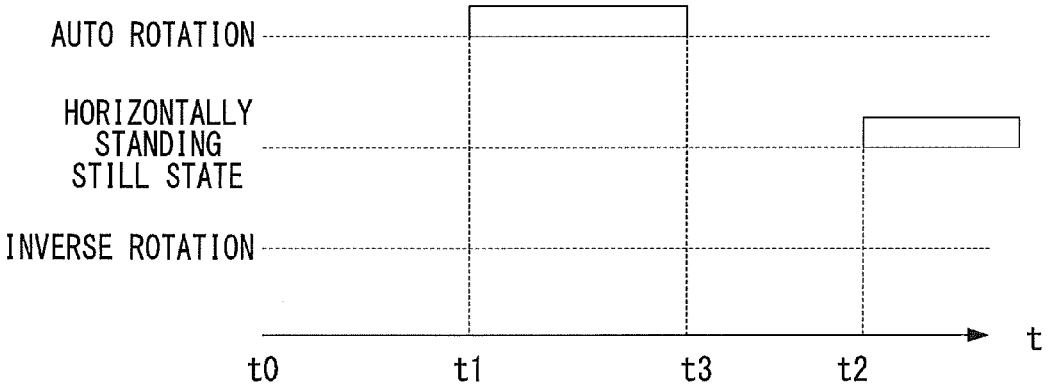

FIGS. 11A to 11C are timing charts for explaining the operation of the information processing device 100. In each timing chart in FIGS. 11A, 11B, and 11C, the vertical axis represents "auto rotation", "horizontally standing still state", and "inverse rotation" and the horizontal axis represents time (t). Note that, the outline of the operation of the information processing device 100, which is described with these drawings, will be following (1) to (5).

(1) At time t0 (t=0), user starts the action of placing the information processing device 100 on a horizontal surface.

(2) At time t1, the auto rotation of the display image is started according to the change of the posture of the information processing device 100. A sequential motions of operation of the auto rotation of the display image is represented by animation.

(3) At the timing of time t3, the animation for the rotation of the display image ends. It means that the auto rotation of the display image ends and the display image is directed in new direction. Note that, it takes about 400 milliseconds for the animation for the auto rotation of the display image to end the animation and turn to the new direction (=t3−t1).

(4) At the timing of time t2, the information processing device 100 is placed on the horizontal surface. It means that, the horizontally standing still state determination unit 304 determines that the information processing device 100 is in horizontally standing still state after the time t2.

(5) The timer 1 at the processing of S607 is set to stop, for example, after 800 milliseconds. It means that, if the information processing device 100 turned to the horizontally standing still state within 800 milliseconds after the animation for the auto rotation of the display image was started, the auto rotation of the previous display image is cancelled. It means that, the display image is rotated in the opposite direction to get back the display image in the original direction.

Description will be made in detail with regard to these series of processing, giving a particular case.

FIG. 11A illustrates a case where, as an example, time t1, t2, and t3 are respectively set as 850 milliseconds, 1200 milliseconds, and 1250 milliseconds. The information processing device 100 is in horizontally standing still state after the elapse of 350 milliseconds (=t2−t1) from the start of the animation for the auto rotation of the display image. This state is within 800 milliseconds, which is the setup value of the timer 1. Therefore, the rotation of the display image is cancelled. At the timing of t2, the animation for the auto rotation of the display image is being executed. Therefore, at the timing t3, when is the timing that the animation for the auto rotation of the display image ends, the animation for the inverse rotation of the display image is started.

FIG. 11B illustrates a case where, as another example, time t1, t2, and t3 are respectively set as 700 milliseconds, 1200 milliseconds, and 1100 milliseconds. The information processing device 100 is in horizontally standing still state after the elapse of 500 milliseconds (=t2−t1) from the start of the animation for the auto rotation of the display image. This state is within 800 milliseconds, which is the setup value of the timer 1. Therefore, the rotation of the display image is cancelled. At the timing t2, the animation for the auto rotation of the display image has ended. Therefore, the animation for the inverse rotation of the display image is started right away.

FIG. 11C illustrates a case where, as another example, time t1, t2, and t3 are respectively set as 700 milliseconds, 1700 milliseconds, and 1100 milliseconds. The information processing device 100 is in horizontally standing still state after the elapse of 1000 milliseconds (=t2−t1) from the start of the animation for the auto rotation of the display image. This state is over 800 milliseconds, which is the setup value of the timer t1 so that the rotation of the display image is not cancelled.

As described above, the information processing device 100 of the present embodiment determines to cancel the rotation of the display image in a case where the condition that the information processing device 100 horizontally stands still within the first predetermined time after the start of the rotation of the display image by the first display change unit 303 is satisfied. At this time, the second display change unit 306 rotates the display image in the direction opposite to the direction of rotation by the first display change unit 303 and with the same angle.

This enables to cancel the rotation of the display image which is caused according to the posture change of the device during the movement in accordance with the state of the information processing device 100 after the movement. Therefore, the rotation of the display image not intended by the user can be cancelled. For example, in the action of gently placing the information processing device 100 on the desk, the user first touches the outer right side of the information processing device 100 on the desk and then, touches the outer left side of the device on the desk. It means that, if the information processing device 100 horizontally stands still within the time which will likely to take for these actions (the first predetermined time), it is possible to assume that the rotation of the display image at this time is not intended by the user. Further, if the information processing device 100 does not horizontally stand still within the first predetermined time, it is possible to assume that the rotation at this time is intended by the user.

First Modification

Description will be made in detail with regard to another example of determining to cancel the rotation of the display image.

Figure 12:
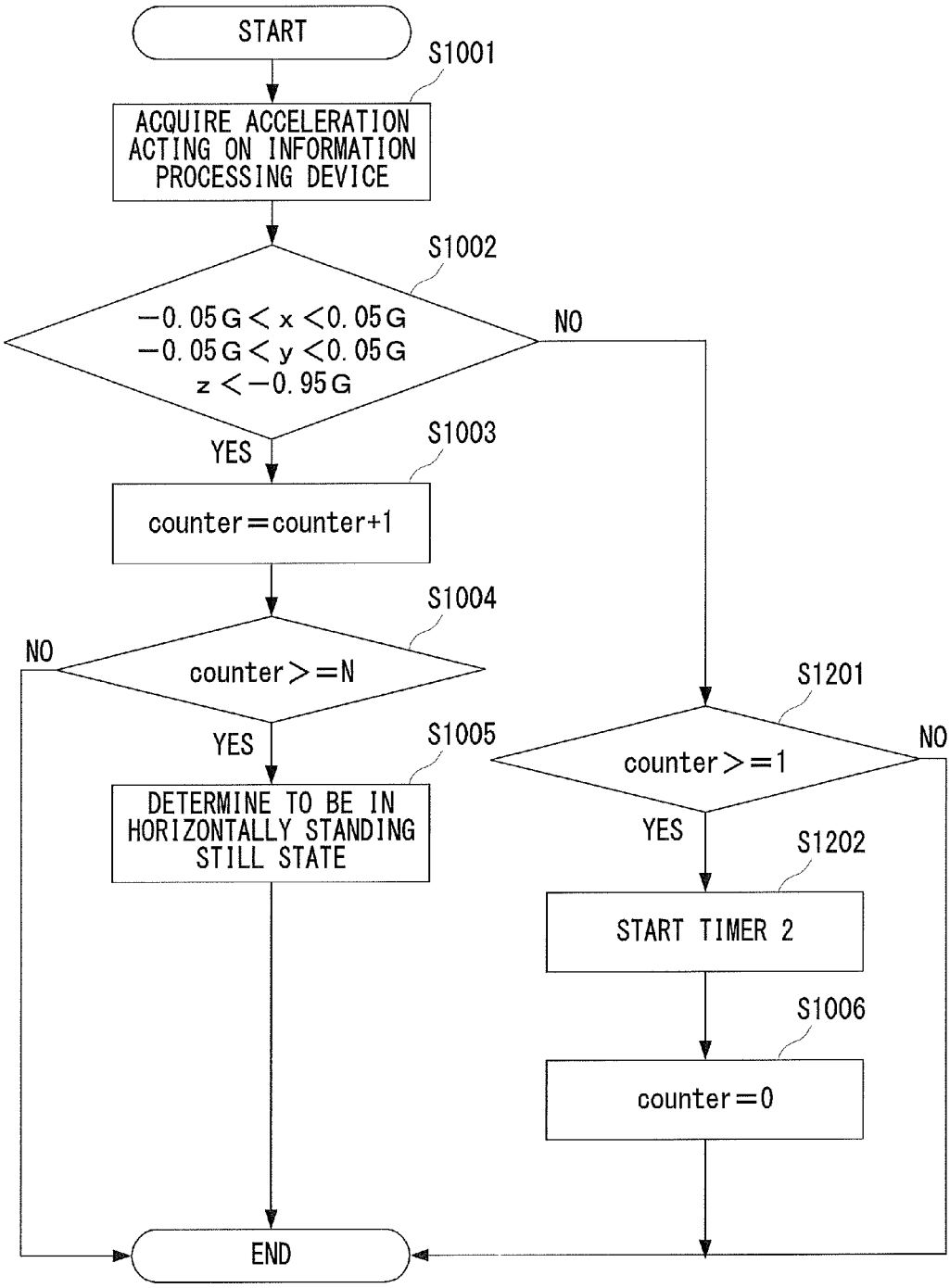
FIG. 12 is a flowchart showing another example of processing procedure of horizontally standing still state determination.

First, description is made with regard to horizontally standing still state determination. FIG. 12 is a flowchart showing another example of processing procedure of the horizontally standing still state determination (horizontally standing still state determination unit 304, S1101). Each processing of S1001 to S1006 in FIG. 12 is as explained in FIG. 10.

The horizontally standing still state determination unit 304 determines whether or not the value of the variable counter is equal to or more than "1" (S1201). If it is determined to be equal to or more than "1" (S1201: YES), measurement is started by the timer 2 (second measurement) (S1202). If it is determined not to be equal to or more than "1" (S1201: NO), the processing is ended. For example, the timer 2 is set such that the state turns to "stop" state after 1200 milliseconds. In this case, processing to send stop command to the timer 2 is not included. Therefore, the timer 2 always turns to "stop" state if the time as previously set is elapsed (in this case, 1200 milliseconds), Here, timer 2 is started in the processing of S1202 when the following conditions are satisfied.

(1) The information processing device 100 has moved. The movement is determined by the movement determination unit 307. For example, if it is determined that the information processing device 100 does not horizontally stand still in the processing of S1002, the information processing device 100 is determined to have moved.

(2) The value of the variable counter is determined to be equal or more than "1" in the processing of S1201. It means that, when it is determined in the last horizontally standing still state determination that the information processing device 100 has horizontally stood still, the information processing device 100 is determined to have moved.

From the above conditions (1) and (2) together, when the information processing device 100 started to move from the horizontally standing still state, the measurement by the timer 2 is started. It means that the timer 2 turns to "in operation" state by the time previously set (the second predetermined time) after the start of the movement of the information processing device 100. On the contrary, if the timer 2 is in "stop" state, it means that the information processing device 100 has successively moved over the second predetermined time.

Figure 13:
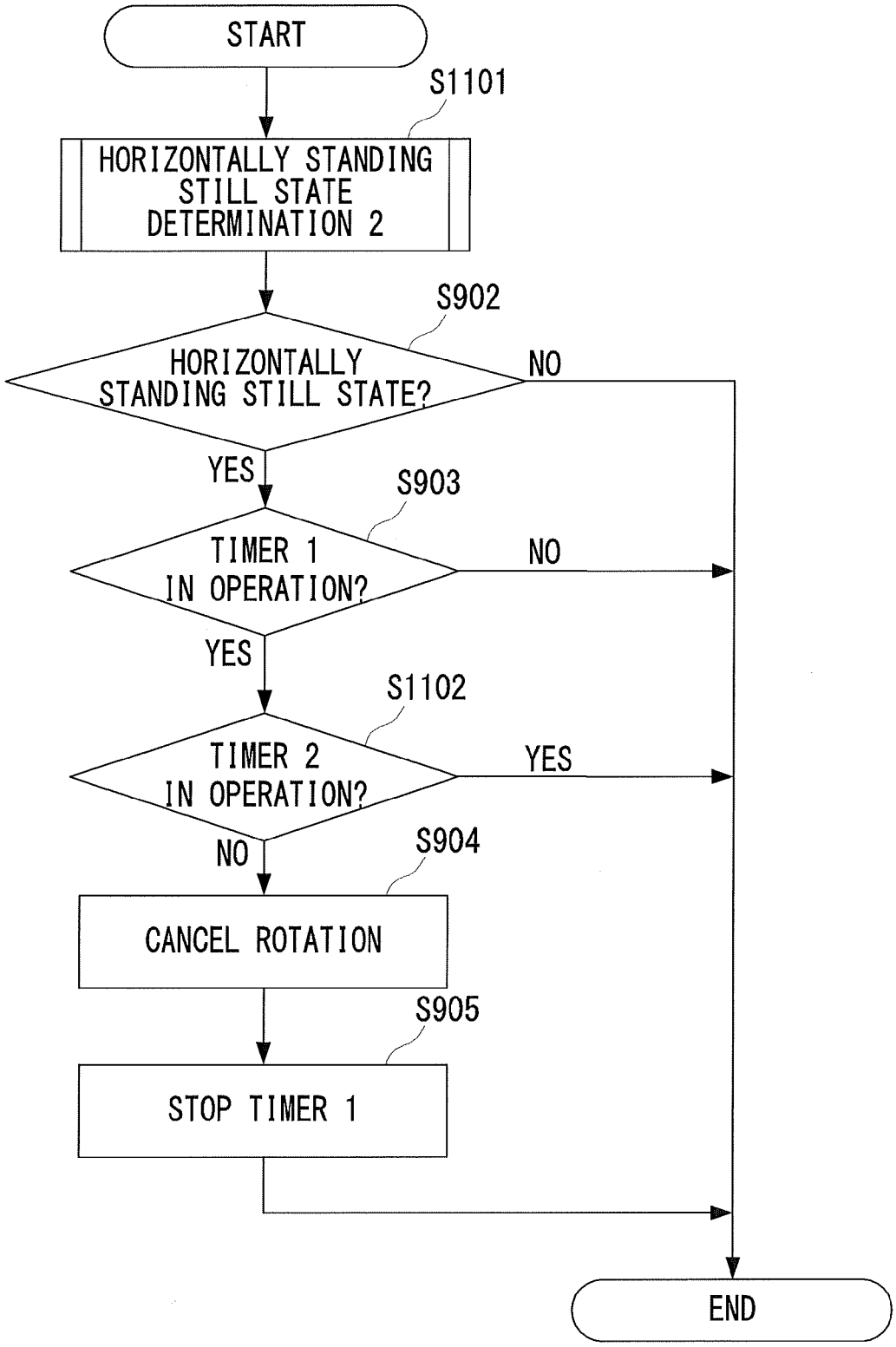
FIG. 13 is a flowchart for explaining particular processing procedure of determining to cancel the rotation of the display image.

Next, determination to cancel the rotation of the display image is described. FIG. 13 is a flowchart showing another example of processing procedure of determining to cancel the rotation of the display image (rotation cancel determination unit 305, S603). Each processing of S902 to S905 in FIG. 13 is as explained in FIG. 9.

The rotation cancel determination unit 305 determines whether or not the information processing device 100 is in horizontally standing still state (S1101).

The rotation cancel determination unit 305 determines whether or not the timer 2 started in the processing of S1202 (FIG. 12) is in "in operation" state (S1102). If it is determined to be in "in operation" state (S1102: YES), the processing is ended. If it is determined to be in "stop" state (S1102: NO), the processing moves to the processing of S904.

The difference from the processing procedure of the horizontally standing still state determination as shown in FIG. 9 is that when the timer 2 is in "in operation" state (S1102:YES), the rotation cancel determination unit 305 determines not to cancel the rotation of the display image. It means that the rotation cancel determination unit 305 does not cancel the rotation of the display image from the start of the movement of the information processing device 100, which is in horizontally standing still state, until the elapse of the second predetermined time. Therefore, the rotation of the display image is canceled in a case where the information processing device is determined to horizontally stand still within the first predetermined time from the start of the rotation of the display image and the information processing device 100 is determined to be successively moving over the second predetermined time.

Suppose that the information processing device 100 is placed, for example, on the desk as shown in FIG. 2B in a state where the "display image in rightward direction". Further, the user is in downward direction of the information processing device 100, viewing from the front of FIG. 2B. In this state, a situation is assumed where the user lifts the upper side of the information processing device 100 (floats the device from the desk) to turn the state to the "display image in upward direction', and places the information processing device 100 on the desk right away. In this case, the overall time that the information processing device 100 takes from the start of the auto rotation of the display image to be in horizontally standing still state (placed on the desk) is assumed to be shorter than the first predetermined time (timer 1). However, time taken from lifting up the upper side of the information device 100 to be in horizontally standing still state (placed on the desk) is also short. It means that the movement time of the information processing device 100 is shorter than the second predetermined time (timer 2). Therefore, the rotation of the display image is not cancelled and the display image is maintained in the direction intended by the user.

Figure 14:
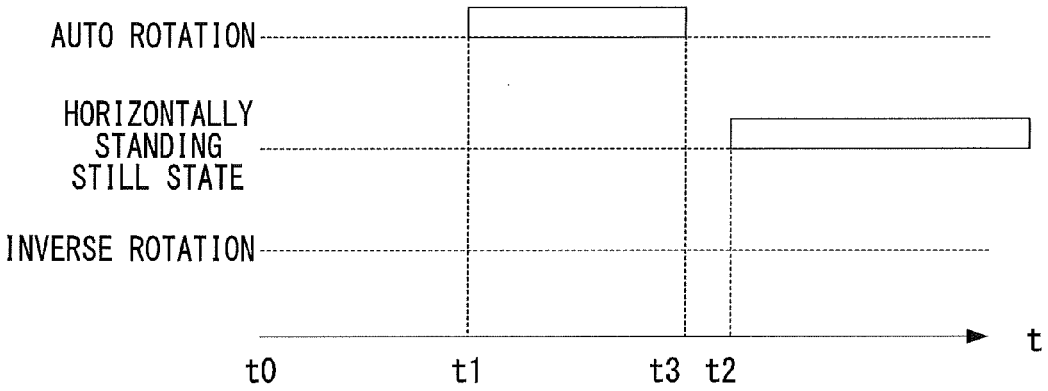
FIG. 14 is a timing chart for explaining operation timing of the information processing device in the first modification.

FIG. 14 is a timing chart for explaining the operation of the information processing device 100 in the first modification. In the timing chart shown in FIG. 14, the vertical axis represents "auto rotation", "horizontally standing still state", and "inverse rotation" and the horizontal axis represents time (t). The operation as shown in FIG. 12 and FIG. 13 will be described with the timing chart shown in FIG. 14. Note that the same reference symbols are used for those overlapping with the description in FIG. 13 and description thereof is omitted.

FIG. 14 is a case where, as one example, time t1, t2, and t3 are respectively set as 600 milliseconds, 1100 milliseconds, and 1000 milliseconds. The information processing device 100 shall be in horizontally standing still state immediately before t0 (t=0). The information processing device 100 is in horizontally standing still state after the elapse of 500 milliseconds (=t2−t1) from the start of the animation for the auto rotation of the display image. This state is within 800 milliseconds, which is the setup time of the timer 1. However, the movement time of the information processing device 100 is 1100 milliseconds (=t2−t0). This is shorter than 1200 milliseconds, which is the setup time of the timer 2. It means that the information processing device 100 has not moved more than the previously setup time. Therefore, the rotation of the display image is not cancelled.

As described, the rotation of the display image is cancelled in a case where the information processing device has determined to horizontally stand still within the first predetermined time and the information processing device 100 has successively moved over the second predetermined time before the time the information processing device is determined to be horizontally stand still.

Second Modification

Determination of whether or not the information processing device 100 has moved may be made according to the inclination change of the information processing device 100. For example, the inclination change of the information processing device 100 can be detected according to the acquired gravity acceleration. In particular, variation of the gravity acceleration component in three directions (direction x, direction y and direction z) per unit time is defined as inclination variation of the information processing device 100. Then, when each of the variation of the component in three directions became equal to or more than the predetermined value, it is determined that the inclination of the information processing device 100 has changed.

Further, gyro sensor may be used to detect the inclination change of the information processing device. The rotating speed of the respective axes of the component in three directions (x direction, y direction, z direction) is obtained with the gyro sensor. When each of the rotating speed became equal to or more than the predetermined value, it is determined that the inclination of the information processing device has changed.

Note that, it is also possible to determine, by the movement determination unit 307, whether or not the rotation of the display image according to the posture (inclination) change of the information processing device 100 is with user's intention. The display image is rotated whenever the inclination of the information processing device 100 has changed. It means that, it is possible to determine whether or not the information processing device 100 has moved according to the inclination change of the information processing device 100, Third Modification It is also possible to configure such that the rotation of the display image by the first display change unit 303 is interrupted and the inverse rotation of the display image by the second display control unit 306 is started. In this case, the display image is rotated in the direction opposite to the direction of rotation by the first display change unit 303 by the angle rotated by the first display change unit 303 till the interruption.

This enables to minimize the time required to cancel the rotation of the display image.

Forth Modification

It is also possible to configure such that the posture of the information processing device 100 is estimated by an external device to notify the estimated result to the information processing device 100. For example, it is possible to estimate the posture of the information processing device by the image recognition by the external device with camera.

Fifth Modification

Figure 15:
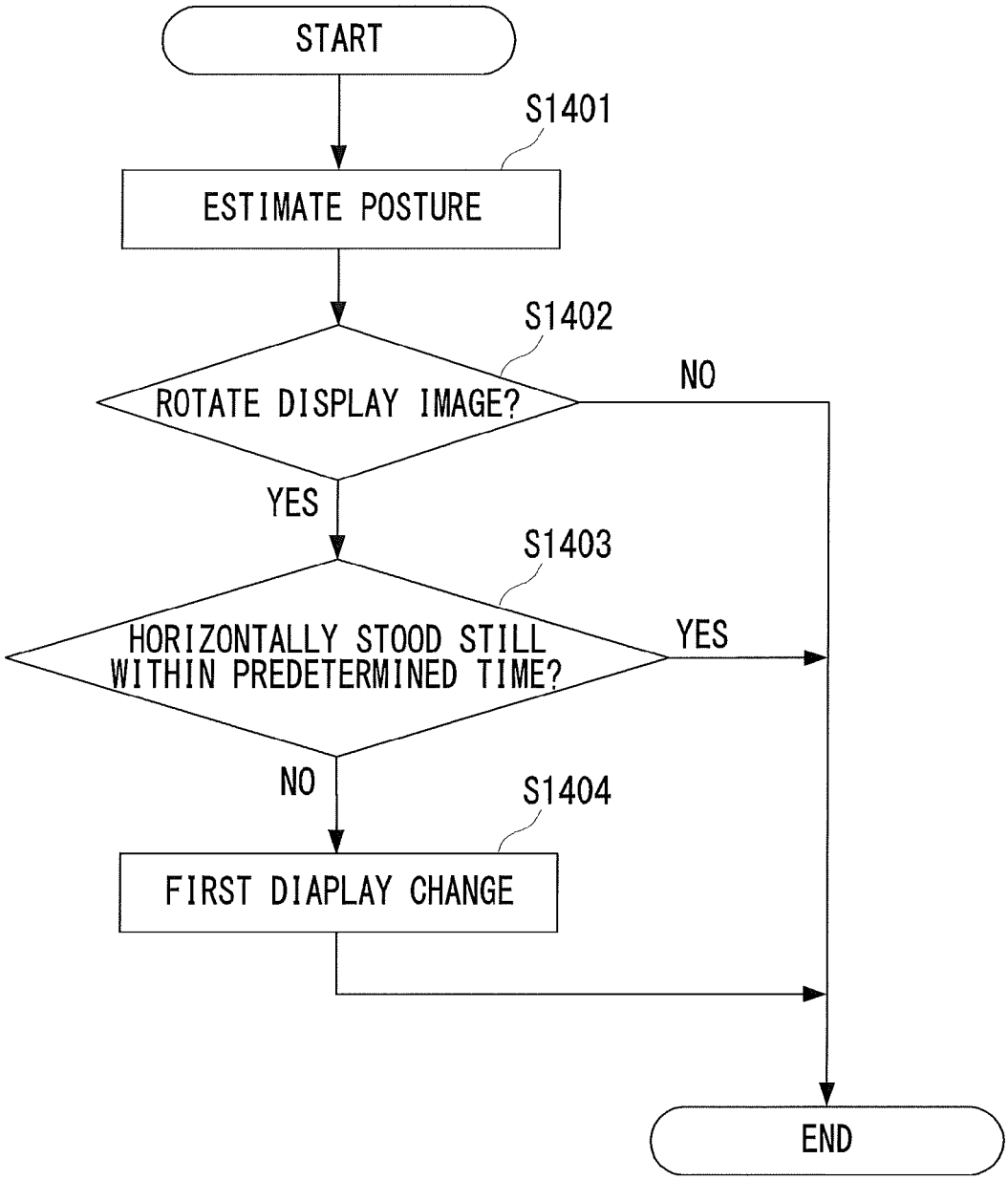
FIG. 15 is a flowchart for explaining basic operation of the information processing device in the fifth modification.

Description is made with FIG. 15 with regard to the processing procedure of starting the rotation of the display image by the first display unit 303 in a case where, after determining whether or not to cancel the rotation of the display image, determination is made not to cancel the rotation of the display image. Note that the same reference symbols are used for those overlapping with the above-mentioned description and description thereof is omitted.

FIG. 15 is a flowchart for explaining the basic operation of the information processing device 100 in this modification.

The rotation determination unit 302 estimates the posture of the information processing device 100 according to the detected gravity acceleration (S1401). The rotation determination unit 302 determines whether or not it is necessary to rotate the display image according to the posture of the information processing device 100 estimated at S1401. If it is determined that it is necessary to rotate the display image (S1402: YES), the direction and the angle to rotate the display image are derived. Then, the processing moves to the processing of S1403. If it is determined that it is not necessary to rotate the display image (S1402: NO), the processing is ended. Note that, the information on the derived direction and angle to rotate the display image is stored, for example, in the RAM 102.

The rotation cancel determination unit 305 determines whether or not to cancel the rotation of the display image (S1403). The cancellation of the rotation of the display image is determined in a case where, within a predetermined time after the rotation determination unit 302 determined that it is necessary to rotate the display image, the information processing device 100 is determined to horizontally stand still by the horizontally standing still state determination unit 304. If it is determined to cancel the rotation (S1403: YES), the processing is ended. If it is determined not to cancel the rotation (S1403: NO), the first display change unit 303 rotates the display image (S1404).

This prevents the display image from unnecessary rotation, which effectively utilizes resources and helps to increase the user's visibility.

Sixth Modification

It is possible to realize storage medium in which software program codes for realizing functions in above-described embodiments and variations are stored can be realized by providing such storage medium with system or device. In particular, the computer of the system or the device (or CPU or MPU) reads out and executes the program code stored in the storage medium.

The storage medium for providing the program code includes, for example, flexible disk, hard disk drive, optical disk, magnetic optical disk, CD-ROM, CD-R, magnetic tape, nonvolatile memory card, ROM, and the like.

Further, it is possible to make operating system (OS) executing on the computer perform part of or all actual processing in accordance with the instruction of the program code read out by the computer. Alternatively, at first, writing the program codes, which are read out from the storage medium, into memory provided on function extension board inserted into the computer or function extension unit connected to the computer. Then, in accordance with the instruction of the program code, it is possible to make CPU, which is provided with the function extension board or the function extension unit, perform part of or all actual processing.

The above-mentioned embodiments are to particularly explain the present invention and that the scope of the present invention is not limited to these embodiments.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of priority from Japanese Patent Application No. 2013-082185, filed Apr. 10, 2013, which is hereby incorporated by reference herein in its entirety.

What is claimed is:

1. An information processing device for controlling direction of a display image to display on a display section, comprising:

an acquisition unit configured to periodically acquire information indicating a posture of the information processing device;

a first display change unit configured to rotate the display image in a case where the posture of the information processing device indicated by the information acquired by the acquisition unit is changed;

a rotation cancel determination unit configured to determine, using information which is acquired by the acquisition unit after start of the rotation of the display image performed by the first display change unit, whether or not to cancel the rotation of the image by the first display change unit; and a second display change unit configured to rotate the display image backward, in a case where it is determined to cancel the rotation of the display image by the rotation cancel determination unit, to change the direction of the display image back to the direction of the display image before the rotation by the first display change unit.

2. The information processing device according to claim 1, further comprising a horizontally standing still determination unit for determining, according to the information periodically acquired by the acquisition unit, whether or not the information processing device stands still more than a first period on a horizontal surface within a second period after the start of the rotation of the display image by the first display change unit;

wherein the rotation cancel determination unit determines to cancel the rotation of the display image by the first display change unit in a case where the horizontally standing still determination unit determines that the information processing device horizontally stands still more than the first period within the second period.

3. The information processing device according to claim 1, further comprising:

a storing unit configured to store the rotation direction and a rotation angel rotated by the first display change unit, wherein the second display change unit is configured to rotate, in a case where it is determined to cancel the rotation of the display image by the rotation cancel determination unit, the display image in a direction opposite to the rotation direction of the rotation performed by the first display change unit stored in the storing unit and with the rotation angle rotated by the first display change unit.

4. The information processing device according to claim 1, further comprising:

a derivation unit configured to derive a rotation direction and a rotation angle of the display image in the display section according to the results continuously detected by the acquisition unit;

wherein the second display change unit is further configured to change, in a case where it was determined to cancel by the rotation cancel determination unit, the display image in a direction opposite to the rotation direction and with the rotation angel rotated by the first display change unit.

5. The information processing device according to claim 4, wherein, triggered by the ending of the rotation of the display image by the first display change unit, the second display change unit starts to rotate the display image in a direction opposite to the rotation direction and with the rotation angle rotated by the first display change unit.

6. The information processing device according to claim 4, wherein, triggered by the determination to cancel the change of the display image by the first display change unit, the second display change unit interrupts the change of the display image and starts to rotate the display image in a direction opposite to the rotation direction rotated by the first display change unit interrupts the change of the display image and starts to rotate the display image in a direction opposite to the rotation direction rotated by the first display change unit and with the angle rotated by the first display change until the rotation was interrupted by the first display change unit.

7. The information processing device according to claim 4, wherein the first display change unit rotates the display image in the rotation direction and with the rotation angel in a case where it is determined by the rotation cancel determination unit not to cancel to rotate the display image.

8. The information processing device according to claim 1, wherein the acquisition unit is configured to continuously acquire one or any combination of:

whether the information processing device stands still;

whether the information processing device is moved, or whether the information processing device is inclined at a predetermined time interval, or the combination thereof.

9. The information processing device according to claim 1, wherein the acquisition unit comprises an acceleration sensor for detecting inclination change of the information processing device.

10. The information processing device according to claim 9, wherein the acquisition unit is connected to an external device provided outside the information processing device;

wherein the external device comprises a camera, and wherein the acquisition unit is configured to acquire information indicating the posture of the information processing device according to an image recognition result notified by the external device.

11. The information processing device according to claim 9, wherein the accelerator sensor detects gravitation acceleration; and wherein the acquisition unit is configured to detect the inclination change of the informing processing device when variation of gravity acceleration became equal to or more than a predetermined value.

12. The information processing device according to claim 9, wherein the acceleration sensor is a gyro sensor; and wherein the acquisition unit is configured to detect the inclination change of device body when rotating speed acquired by the gyro sensor became equal to or more than a predetermined value.

13. The information processing device according to claim 1, wherein the first display change unit and the second display change unit rotates the display image displayed in the display section by displaying, in the display section, an animation for the rotation of the display image displayed in the display section.

14. The information processing device according to claim 1, wherein:

the display section has four sides and displays the display image in a display direction toward a first side of the four sides;

when the posture indicated by the information acquired by the acquisition unit changes, the first display change unit is further configured to rotate the display image displayed toward the first side in the display section such that the display image is directed to a second side corresponding to the posture which is indicated by the information acquired by the acquisition unit after the change, the second display change unit is further configured to, in response to a determination to cancel the rotation of the display image by the rotation cancel determination unit, rotate the display image to be displayed in a toward the first side of the four sides independent of the posture of the information processing device after the determination of the rotation cancel determination unit.

15. A method for controlling an information processing device, which controls direction of a display image to display on display section, comprising:

acquiring step for periodically acquiring, by an acquisition unit, information indicating a posture of the information processing device;

first display changing step for rotating, by a first display change unit, the display image in a case where the posture of the information processing device indicated by the information acquired by the acquisition unit has changed;

rotation cancel determination step for determining, by a rotation cancel determination unit, using information which is acquired by the acquisition unit after start of the rotation of the display image performed by the first display change unit whether or not to cancel the rotation of the display image in the first display changing step;

second display changing step for rotating the display image backward, by a second display change unit, in a case where it is determined in the rotation cancel determination step to cancel the rotation of the display image, to change the direction of the display image back to the direction of the display image before the rotation rotated in the first display change step.

* * * * *